US010043495B1

(12) United States Patent
Paterson

(10) Patent No.: US 10,043,495 B1
(45) Date of Patent: Aug. 7, 2018

(54) PICK HOLDER

(71) Applicant: Robert Bruce Paterson, Tenafly, NJ (US)

(72) Inventor: Robert Bruce Paterson, Tenafly, NJ (US)

( * ) Notice: Subject to any disclaimer, the term of this patent is extended or adjusted under 35 U.S.C. 154(b) by 0 days.

(21) Appl. No.: 15/727,366

(22) Filed: Oct. 6, 2017

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | |
|---|---|---|---|---|
| 4,875,708 | A | 10/1989 | Sremba et al. | |
| 5,231,238 | A | 7/1993 | Adams | |
| 6,140,564 | A | 10/2000 | Pia | |
| 6,215,052 | B1 | 4/2001 | Giddens | |
| 6,933,430 | B2 | 8/2005 | Oskorep | |
| 7,417,184 | B2 | 8/2008 | Weathersby | |
| 7,626,103 | B1 * | 12/2009 | Phillips | G10D 3/163 84/320 |
| 9,018,502 | B2 | 4/2015 | Aletto | |

* cited by examiner

*Primary Examiner* — Kimberly Lockett
(74) *Attorney, Agent, or Firm* — Garcia-Zamor IP Law; Ruy M. Garcia-Zamor

(57) ABSTRACT

A musical instrument accessory for optimizing the comfort and ease with which musicians can play instruments. The accessory can be manufactured as a high end accessory made with gems and/or can be customized to provide a unique aesthetic appearance. In a preferred embodiment, the accessory allows for multiple picks to be detachably stored which may have different sizes and shapes.

18 Claims, 14 Drawing Sheets

PICK HOLDER

BACKGROUND

The present invention is generally directed to musical instrument accessories and, more specifically, accessories configured to hold multiple picks for musical instruments, such as guitars and banjos, in a portable carrier that allow easy access to these picks.

Many existing pick holders suffer from one or more of several existing deficiencies. Existing holders tend to save space by requiring picks to be stacked and held tightly therein, which is space efficient but can be difficult to load and keeps players from being able to reach multiple picks or store picks of multiple sizes. Other pick holders are often far too large and unwieldy to be easily transported and used, holding a great number of picks in a large container.

It may be advantageous to provide a pick holder that may be configured to: hold picks of varying thickness; hold picks in such a manner that no chamber is configured for a specific thickness of picks; store picks in multiple orientations; allow space to be optimized allowing the pick holder to be smaller and more ornate; hold picks of multiple sizes to be held and for picks to be removed without moving any other picks held within the pick holder; be wearable on a strap or clothing; be more aesthetically pleasing than existing pick holders; be efficient to manufacture; and/or be durable under extended use.

SUMMARY

Briefly speaking, one embodiment of the present invention is directed to a pick holder which may include a holder body formed of a front plate and a rear plate which may define one or more gaps wherein one or more picks can be held. The rear plate may be formed to include a spring member formed of the same piece as the rear plate to detachably secure a pick within the gap. The rear plate may define a first cutout forming a spring bay and defining lateral edges of the first spring member, from which the first spring member may originate. The spring bay may have a trapezoidal shape, and a lateral width of the first spring member may decrease between the first origination end and the first spring tip. The first spring member may include, sequentially, a first origination end which remains connected to, and an integral part of, the rear plate, a first convex surface, a first concave surface, and a first spring tip, providing a distinctive shape. The first spring tip may be positioned at least partially within the first spring bay when no pick is located within the first gap. The first spring member may have a constant thickness throughout the first convex surface and the first concave surface. This thickness may be less than a rear plate thickness along a portion of a perimeter of the spring bay proximate to the first spring tip. A plurality of insert walls may be included within the holder body and configured to abut a portion of the playing end of the pick when the pick is fully inserted into the first gap such that a portion of the gripping end of the pick protrudes from the holder body.

In a separate aspect, the present invention is directed to a pick holder which may include a holder body formed of a front plate and a rear plate which may define one or more gaps wherein one or more picks can be held. The rear plate may be formed to include a first spring member formed of the same piece as the rear plate to detachably secure a pick within the gap. The rear plate may define a first cutout forming spring bay and defining lateral edges of the first spring member, from which the first spring member may originate. The holder body many further define a second gap configured to have the playing end of the pick inserted therein. The rear plate may also be formed to include a second spring member formed of the same piece as the rear plate, which may detachably secure at least one pick within the second gap. The second spring member may include, sequentially a second origination end which remains connected to, and an integral part of, the rear plate, a second convex surface, a second concave surface, and a first spring tip, providing the distinctive shape as the first spring member. A second portion of the rear plate may form a second spring member that extends into the second gap to detachably secure the pick therein, and the rear plate may defines a second cutout forming a second spring bay and defining lateral edges of the second spring member.

In another aspect, the pick holder may include a holder body having a front plate and a rear plate, the holder body further having at least one sidewall extending generally planar perpendicular to the front plate and the rear plate. The holder body may further define a first gap configured to have the playing end of the pick inserted therein. The rear plate may form a first spring member as a single, integral, one piece body that extends into the first gap to detachably secure picks therein. The first spring member may include, sequentially a first origination end which remains connected to and an integral part of the rear plate, a first convex surface, a first concave surface, and a first spring tip, providing a distinctive shape. The first spring member may have a constant thickness throughout the first convex surface and the first concave surface, and the width of the first spring member may decrease between the first origination end and the first spring tip. The first spring tip may be positioned at least partially within the first spring bay when no pick is located within the first gap. The first spring member may have a constant thickness throughout the first convex surface and the first concave surface. This thickness may be less than a rear plate thickness along a portion of a perimeter of the spring bay proximate to the first spring tip.

In another aspect, the present invention is direct to a pick holder which may include a holder body comprising a front and rear plate. The rear plate may define a recess into which a clip member may be secured which may partially overlaps a first spring member when the clip member is secured to the holder body.

In another aspect, the present invention is directed to a pick holder which detachably secure picks within the first and second gaps such that the picks are parallel to and adjacent to the front plate. The first and second gaps are preferably positioned on opposing first and second longitudinal ends, respectively, such that at least two picks can be detachably secured in opposite orientations in the pick holder.

In another aspect, the present invention is directed to a pick holder that may be used simultaneously with picks of different sizes and shapes.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENT

Figure 1:
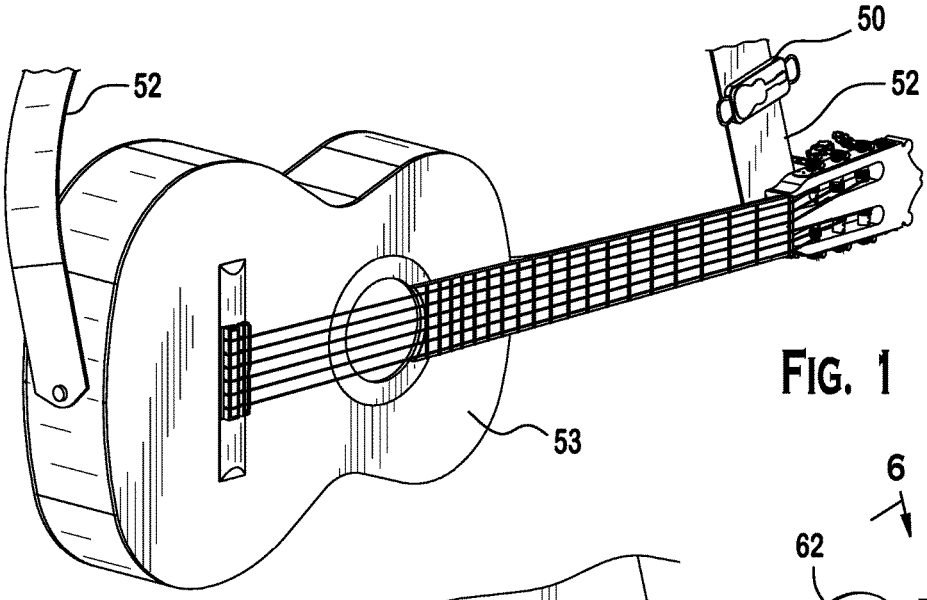
FIG. 1 is a perspective view of a first preferred embodiment of the pick holder 50 affixed to a guitar strap 52 which is itself affixed to a guitar 53. The view demonstrates how the pick holder 50 may be used, and demonstrates how the pick holder 50 would be convenient for a player of the guitar 53. One of ordinary skill in the art would appreciate from this disclosure that the pick holder 50 can be worn in different places, on different articles, and in different manners without departing from the scope of the present invention.

Certain terminology is used in the following description for convenience only and is not limiting. The words "right," "left," "top," and "bottom" designate directions in the drawings to which reference is made. The words "outer" and "inner" refer to directions away from and toward, respectively, the geometric center of the pick holder. The words "front" and "rear" may refer to the side which would be the front and rear when the pick holder is worn on a guitar strap as seen in FIG. 1. Thus the face plate 76 may be said to be on the front, and the clip member 72 may be said to be on the rear. "Longitudinal ends" refers to opposite polar ends of the pick holder when it is placed in the orientation of FIG. 3. The term "generally parallel" designates surfaces positioned within fifteen degrees (15°) of true mathematic parallel, which is to say that in reference to an imaginary stable line bisecting the surfaces, the surface extend away in an angle within fifteen degrees (15°) of the angle of the other surface. Additionally, the words "a" and "one" are defined as including one or more of the referenced item unless specifically stated otherwise. The terminology includes the words above specifically mentioned, derivatives thereof, and words of similar import.

Referring to FIGS. 1-21 wherein like numeral indicate like elements throughout, there are shown preferred embodiments of a pick holder 50, with a pick holder, generally, being a device for securing devices for use by musicians playing stringed instruments. Most generally speaking, this invention is directed toward the storage of guitar picks, being generally triangular pieces of rubber, plastic, or metal. Picks, such as the first pick 62, generally have a wider side comprising two corners, known herein as the gripping end 63, and a narrower end comprising a single corner of a less than 90 degree angle, known herein as the playing end 61. Those of ordinary skill in the art will appreciate from this disclosure that all picks described herein may have similar parts and may be used interchangeably, but not all parts of each pick have been described, for the sake of clarity. Those of ordinary skill in the art will further appreciate from this disclosure that picks of any size or shape may be used in connection with the pick holder 50 without exceeding the scope of this disclosure.

Figure 2:
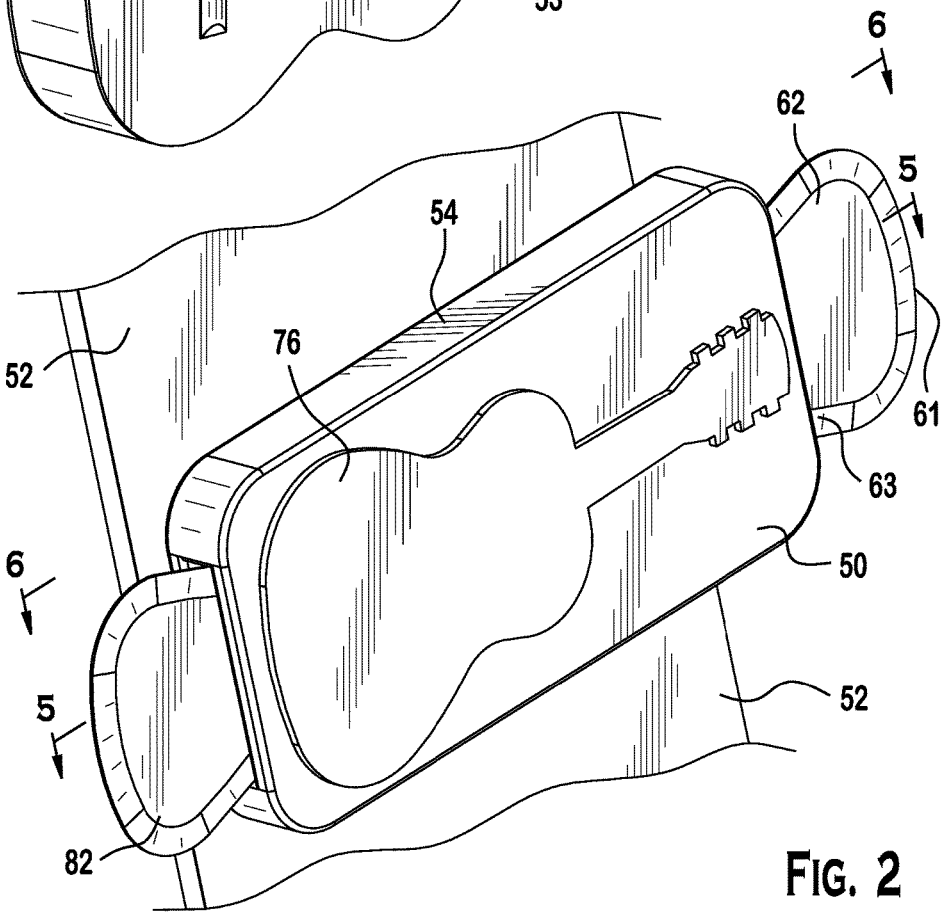
FIG. 2 is an enlarged perspective view of the pick holder 50 of FIG. 1 illustrating the pick holder 50 affixed to a guitar strap 52, which better demonstrates the features of the preferred embodiment of the pick holder 50. The preferred embodiment depicted includes a first pick 62 and a second pick 82 being held detachably within the holder body 54. As can be seen, in the preferred embodiment, the gripping end 63 of the first pick 62 protrudes from the holder body 54. In this embodiment, the pick holder 50 may include a faceplate 76 which may, but not necessarily, be permanently or detachably affixed thereto.

The pick holder 50 is preferably, but not necessarily, configured to hold multiple picks, such as the first pick 62 and second pick 82, such that any one pick can be removed, preferably without moving or causing to be removed from the holder any other pick 62. Referring to FIGS. 1 and 2, the pick holder 50 is preferably configured to be detachably positioned on a guitar strap 52 attached to a guitar 53 such that the pick holder 50 may be used by the player of the guitar 53 while playing. However, those of ordinary skill in the art will appreciate from this disclosure that the pick holder 50 need not be affixed to a guitar strap 52, but rather could be affixed to any other surface, such as a belt, waste band, pocket, or no surface at all, without departing from the scope of the present invention.

The pick holder 50, and its component parts, are preferably formed of a suitably durable, strong material, such as a metal or alloy. However, those of ordinary skill in the art will appreciate from this disclosure that any suitable material can be used without departing from the scope of the present invention. For example, the pick holder 50 may be formed of a suitable polymer or metal without departing from the scope of the present invention. The pick holder can be formed using CNC equipment, injection molding, or using any other suitable manufacturing process without departing from the scope of the present invention.

Figure 3:
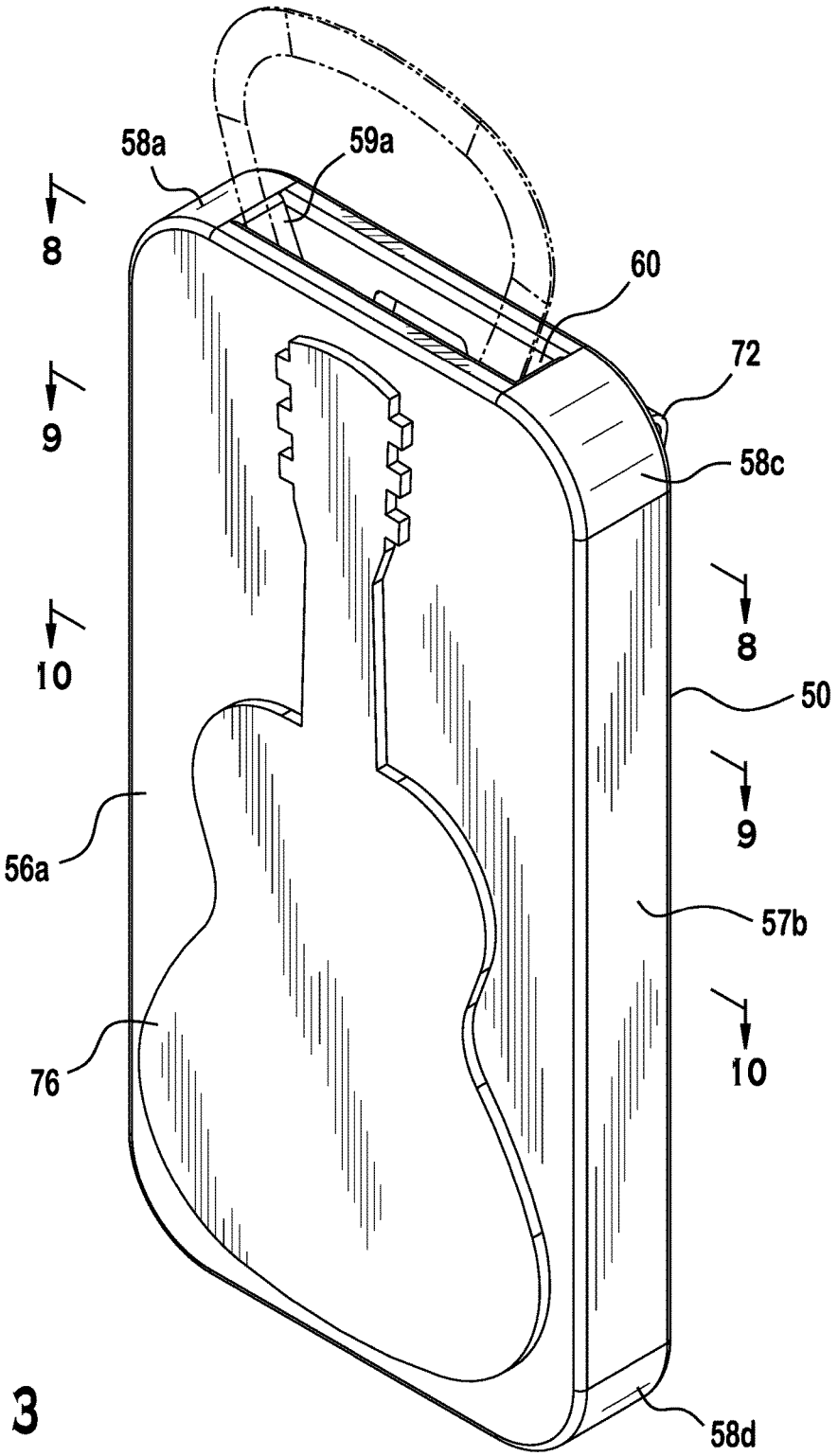
FIG. 3 is a front perspective view of the pick holder 50 of FIG. 1 which demonstrates the preferred embodiment of the pick holder 50 including a holder body 54 formed of a front plate 56*a* and a rear plate 56*b* which define a first gap 60 into which a the playing end 61 of the first pick 62 may be inserted. The front plate 56*a* may define first and second sidewalls 57*a* and 57*b* which may define first, second, third, and fourth corners 58*a-d*.
Figure 4:
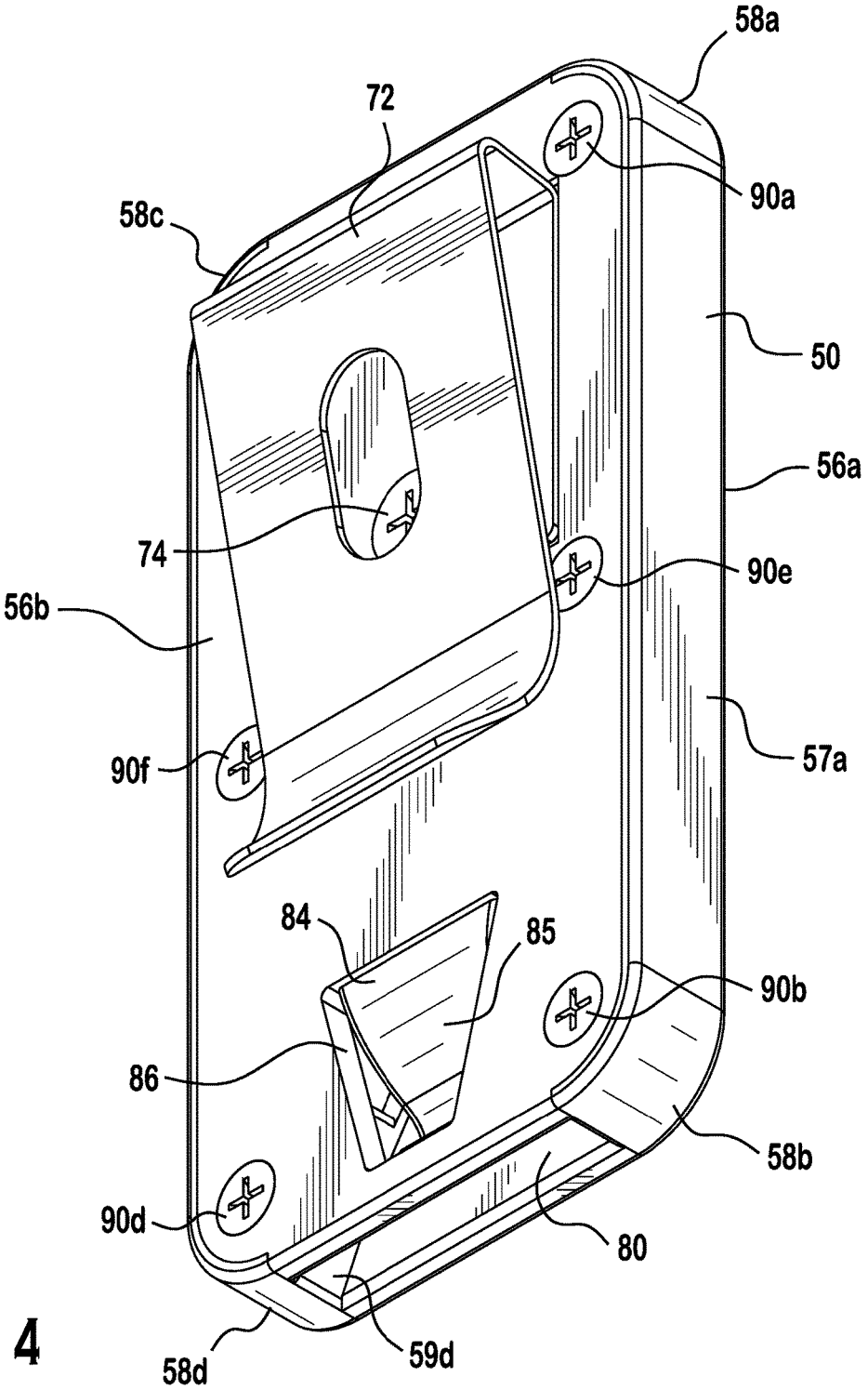
FIG. 4 is a rear perspective view of the pick holder 50 of FIG. 3 which demonstrates the preferred embodiment of the holder body 54 includes a rear plate 56*b*. The rear plate 56*b* preferably allows clamping screws 90*a-f* to pass there through to hold the rear plate 56*b* to the front plate 56*a*. The pick holder 50 preferably also includes a detachable clip member 72 which may be detachably affixed thereto by a fastener screw 74. The figure further demonstrates that the holder body 54 preferably includes a second gap 80 in the bottom side thereof.
Figure 12:
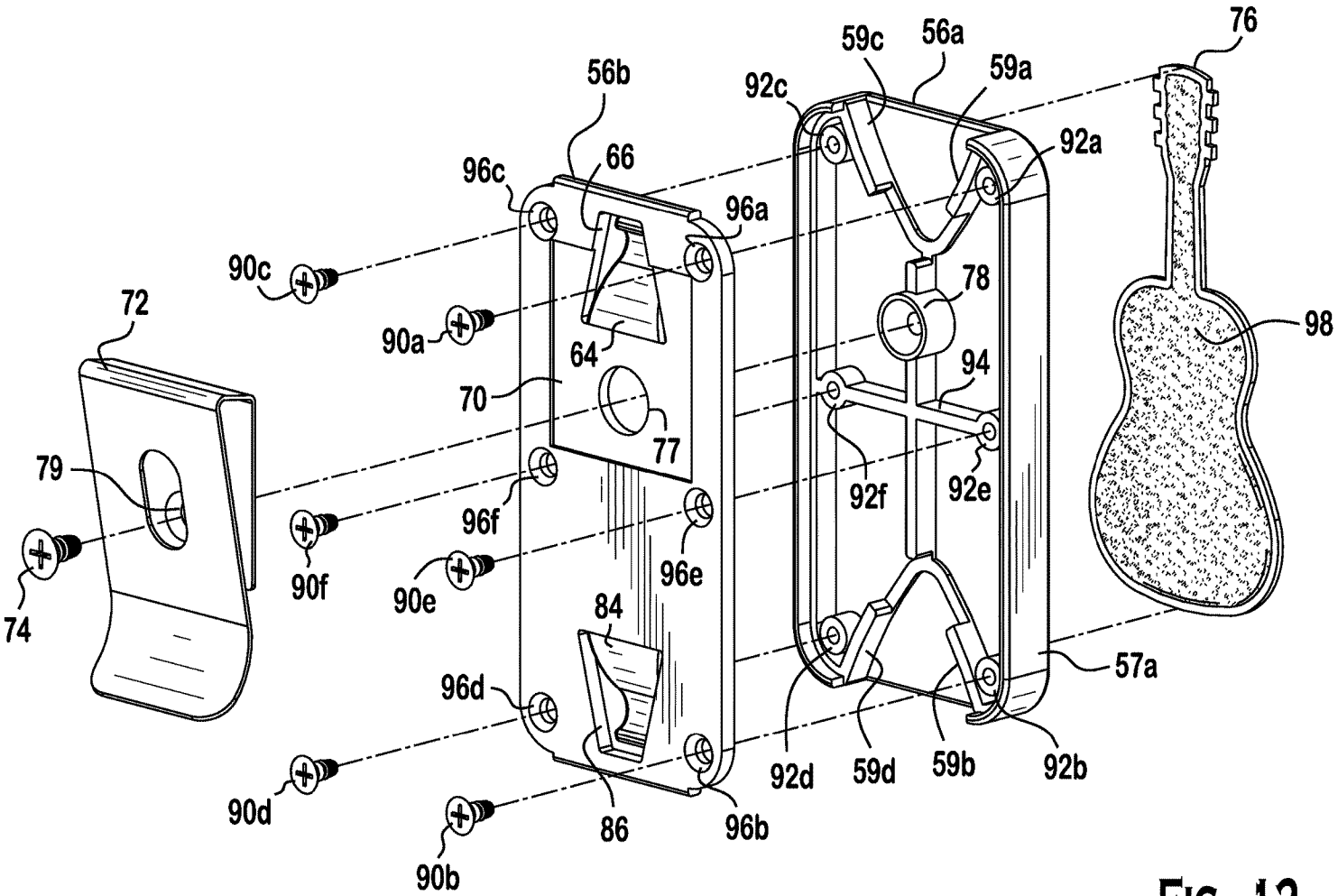
FIG. 12 is an exploded view of the pick holder 50 of the present invention demonstrating the preferred manner in which the pick holder 50 may be assembled. It is preferred that the face plate 76 be placed on the front of the front plate 56*a*, and adhered thereto by an adhering element 98, such as magnets or glue. It is then preferred that the rear plate 56*b* placed against the rear of the front plate 56*a* the clamping bores 96*a-f* aligning with the screw housings 92*a-f*, and the bore placement hole 77 over the fastener housing 78. It is then preferred that the clip member 72 be placed into the clip member recess 70 with the fastener bore being positioned into the bore placement hole 77. It is preferred that the fastener screw 74 be placed into the fastener bore 79 and screwed into the fastener housing 78, clamping the clip member 72 and rear plate 56*b* to the front plate 56*a*. It is further preferred that clamping screws 90*a-f* be placed into the corresponding clamping bores 96*a-f* and screwed into the corresponding screw housing 92*a-f*, providing a uniform clamping force to attach the rear plate 56*b* to the front plate 56*a*.
Figure 13:
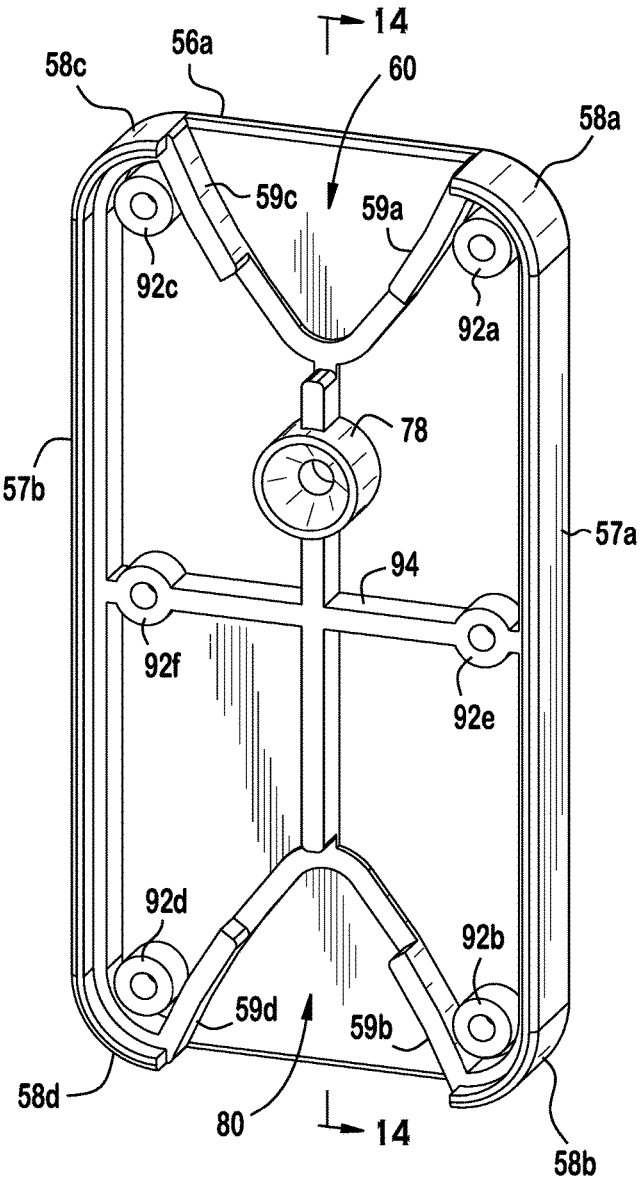
FIG. 13 is front perspective view of the front plate 56*a* demonstrating the preferred relative heights of the structures on the underside of the front plate 56*a*. It is preferred that the sidewalls 57*a-b* are the highest structure, with the fastener housing 78 being the next highest. It is then preferred that the screw housings 92*a-f*, support frame 94, and insert walls 59*a-d* be of a uniform height.
Figure 14:
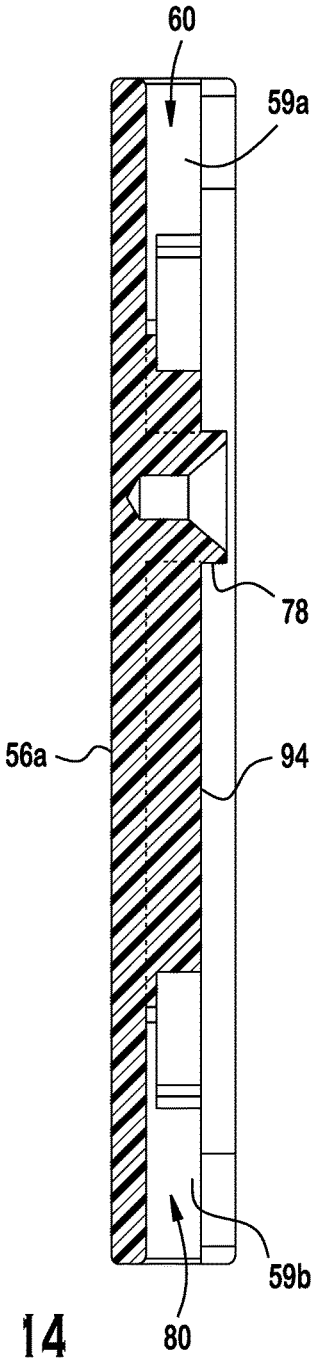
FIG. 14 is a cross sectional view of the of the pick holder 50 assembled with the front plate 56*a* as seen in FIG. 13, further demonstrating the preferred heights of the fastener housing 78 and support frame 94 in relation to each other.
Figure 15:
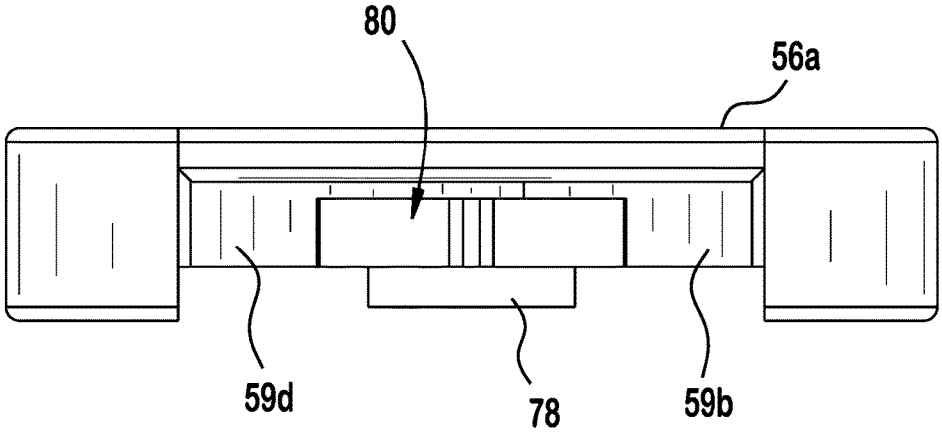
FIG. 15 is a top plan view of the front plate 56*a*, as it would be placed against the rear plate 56*b* as show in FIG. 16. The figures show the general preferred position of the first 60 in relation to the first and third corners 58*a* and 58*c*, as well as the preferred height of the first gap 60 in relation to the fastener housing 78, support frame 94, and first and third insert walls 59*a* and 58*c*. Those of ordinary skill in the art will appreciate from this disclosure that the same preferred heights may be applied to the second gap 80 in relation to its corresponding corners 58*b* and 58*d* and insert walls 58*b* and 59*d*.
Figure 16:
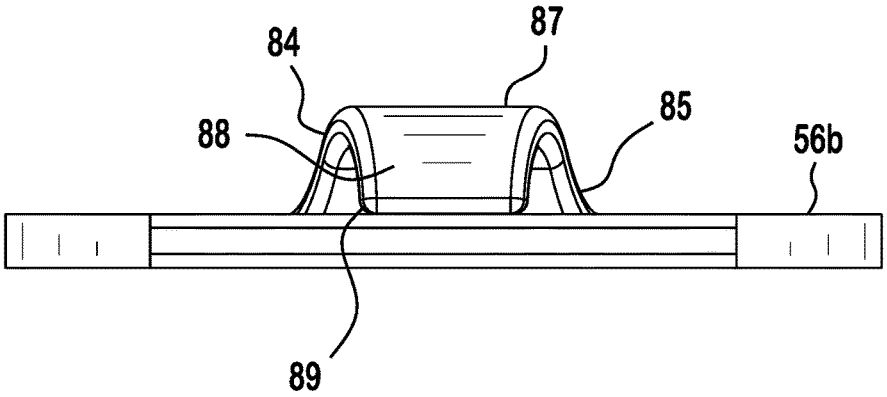
FIG. 16 is a top plan view of the rear plate 56*b*, as it would be placed against the front plate 56*a* as show in FIG. 15. The figure demonstrates the preferred height at which the first spring member 64 may protrude inward from the rear plate 56*a* into the first gap 60, especially when viewed alongside FIG. 15. The figure allows the first spring tip 69, first convex surface 65, and first concave surface 67 to be seen, demonstrating the preferred shape of the first spring member 65.
Figure 17:
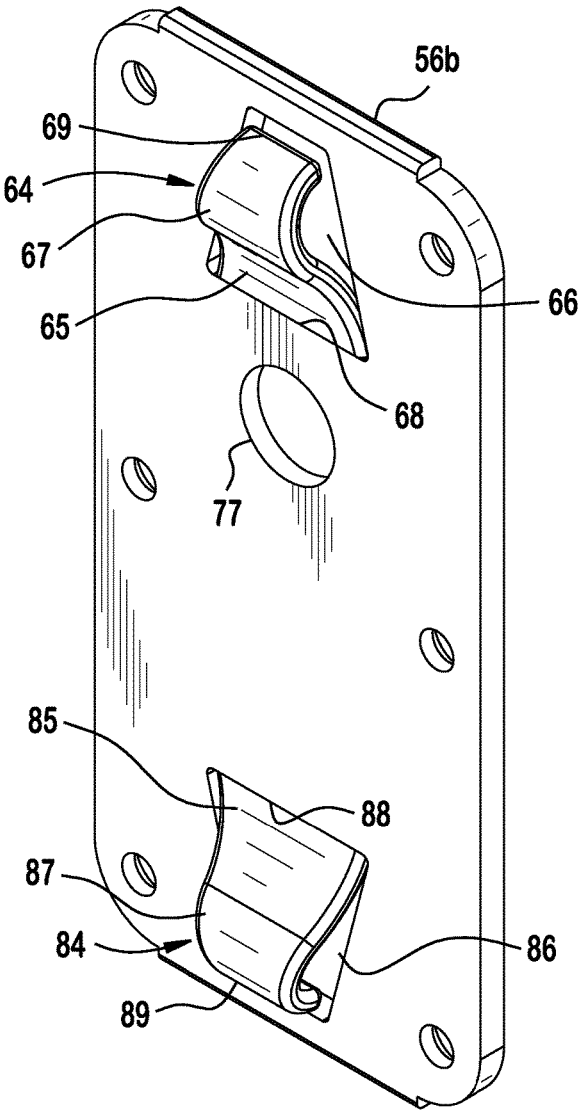
FIG. 17 is a perspective view of the inner side of the rear plate 56*b*. This view allows the full shape of the first spring member 64 and second spring member 84 to be seem. From the first origination end 68, the first spring member 64 includes first a first convex surface 65, then a first concave surface 67, and then a first spring tip 69. Similarly, the second spring member 84 may include, from the second origination end 88, a second convex surface 85, then a second concave surface 87, and then a second spring tip 89. It is preferred that the first spring member 64 and second spring member 84 be of an identical shape but be provided in a mirror image configuration about the central horizontal axis of the holder body 54.

Referring to FIGS. 3, 4, and 12, the pick holder 50 preferably includes a holder body 54 formed of a front plate 56*a* and a rear plate 56*b*. However, the holder body 54 may be formed of a single piece, such as a holder body formed of molded plastic or metal, or may include more than two plates.

In some embodiments, the pick holder 50 further includes a decorative face plate 76 which may be affixed to the front side, or outer face, of the front plate 56*a* using an adhering element 98. The adhering element 98 may be formed of any suitable adhesive means, such as glue, hook-and-loop fastener, or magnets. However, in some preferred embodiments, no face plate 76 may be included. Those of ordinary skill in the art will appreciate from this disclosure that any suitable adhesive means may be used without exceeding the scope of this disclosure. The holder body 54 further having at least one sidewall extending generally planar perpendicular to the front plate 56*a* and the rear plate 56*b*, which may provide the holder body 54 with a roughly rectangular prism shape. It is preferred that the side wall extend from the front plate 56*a*. However, those of ordinary skill in the art will appreciate from this disclosure that the one or more side walls may be provided as a separate piece without exceeding the scope of this invention. In the preferred embodiment, the holder body comprises two side walls, a first side wall 57*a* and a second side wall 57*b*. The first and second side walls are separated by a first gap 60 and a second gap 80, necessitating two side walls. However, in embodiments wherein only a first gap 60 is formed, only a single side wall may be present. Those of ordinary skill in the art will appreciate from this disclosure that any number of side walls may be provided without exceeding the scope of this invention.

The first gap 60 is preferably formed between the front plate 56*a* and the rear plate 56*b* when the interior sides of each are placed against the other. The first gap 60 is preferably configured to have the playing end 61 of the first pick 62 inserted therein. In some embodiments, the first gap 60 may allow for the insertion of two or more picks. Those of ordinary skill in the art will appreciate from this disclosure that the first gap 60 may be configured to hold more than one and as many as six picks without exceeding the scope of this disclosure.

Referring to FIGS. 12 and 15-19, the rear plate 56*b* is roughly rectangular in shape, and is preferably smaller than the front plate 56*a* such that it may rest inside the inner perimeter of the first and second side walls 57*a* and 57*b* if said side walls extend from the front plate 56*a*. Preferably, a first portion of the rear plate 56*b* preferably forms a first spring member 64 that extends into the first gap 60 to detachably secure the first pick 62 therein. It is preferred that the first spring member 64 and the rear plate 56*b* be a single, integral, one piece body. In other words, it is preferred that the rear plate 56*b* is a single piece, and that the first spring member 64 be a portion of the rear plate 56*b* which has been formed into its unique shape.

It is preferred that the rear plate 56*b* defines a cutout which forms a first spring bay 66 which may define lateral edges of the first spring member 64. It is preferred that the first spring bay 66 have a trapezoidal shape, as such a shape best suits the preferred shape of the first spring member 64, with the wider end being the first origination end 68 of the first spring member 64. This shape may allow the first spring member 64 to bend without significant risk of outside debris or matter impeding the first spring member 64. However, those of ordinary skill in the art will appreciate from this disclosure that the first spring bay 66 may be provided in any suitable shape without exceeding the scope of this invention.

In some embodiments, it is preferred that the rear plate 56*b* defines a clip member recess 70, into which a clip member 72 may be secured by a fastener screw 74. Preferably, the clip member recess 70 may be rectangular, with the base of the clip member 72 also being of the same shape. Such a configuration preferably allows the clip member 72 to be secured within the clip member recess 70. In its preferred placement, the clip member recess may be positioned adjacent to part of the first spring bay 66, such that the clip member 72 partially overlaps the first spring member 64 when the clip member 72 is secured to the holder body 54. However, those of ordinary skill in the art will appreciate from this disclosure that the clip member 72 and/or clip member recess 70 may be omitted or may be included in varying shapes or attached through varying means without exceeding the scope of this invention. In other embodiments, no clip member 72 may be provided, and other attachment means may be provided to attach the pick holder 50 to clothing or a guitar 53 or guitar strap 52, or no attachment means may be included at all.

Referring first to the rough geometric shape of the perimeter of the first spring member 64 preferably begins with a first origination end 68 extending from the rear plate 56*b*, and ends in a first spring tip 69. The first spring member 64 is further preferably roughly trapezoidal in shape, with a lateral width of the first spring member 64 decreasing between the first origination end 68 and the first spring tip 69. However, those of ordinary skill in the art will appreciate from this disclosure that the first spring member 64 may be rectangular, triangular, or make take any other suitable shape without exceeding the scope of this disclosure.

Referring next to the three-dimensional curvature of the first spring member 64, it is preferred that the first spring member 64 has both a convex and a concave curve, such that the first spring member 64 resembles an ocean wave. Specifically, from the first origination end 68, it is preferred that the first spring member 64 extend to define a first convex surface 65, then to form a first concave surface 67 before ending in the first spring tip 69. It is preferred that the first spring member 64 be sufficiently curved such that it extends to fill a significant portion of the first gap 60 when no pick is located within the first gap 60, preferably between 50 and 95% of the vertical space in the first gap 60. At the same time, it is also preferred that the first spring member 64 be sufficiently curved such that the first spring tip 69 is at least partially within the first spring bay 66 when no pick is located within the first gap 60.

Referring to the width of the first spring member 64, it is preferred that the first spring member 64 have a constant thickness throughout the first convex surface 65 and the first concave surface 67. It is further preferred that this constant thickness of the first spring member 64 be less than the thickness of the rear plate along a portion of a perimeter of the spring bay proximate to the first spring tip.

Referring to FIGS. 4 and 15-19, it is further preferred that the holder body 54 further define a second gap 80 between the front plate 56*a* and the rear plate 56*b*, with the second gap 80 also being configured to have some or all of one or more picks or the playing ends of one or more picks, such as the second pick 82, inserted therein. It is preferred that the second gap 80 be positioned such that first and second gaps 60, 80 are positioned on opposing longitudinal end of the holder body 54 such that at least two picks 62, 82 can be detachably secured in opposite orientations in the pick holder 50. In other words, such a configuration allows the playing end 61 of one pick may face generally downward while the playing end 63 of another pick may face generally upward. However, those of ordinary skill in the art will appreciate from this disclosure that the first gap 60 and second gap 80 may be included in any position relative to the other without exceeding the scope of this invention. It is also preferred that the first gap 60 and second gap 80 be configured to detachably secure picks such that the picks are held generally parallel to and adjacent to the front plate 56*a*.

It is further preferred that a second portion of the rear plate 56*b* preferably forms a second spring member 84 that extends into the second gap 80 to detachably secure the second pick 82 therein. It is preferred that the second spring member 84 and the rear plate 56*b* be a single, integral, one piece body. In other words, it is preferred that the rear plate 56*b* a single piece, and that the second spring member 84 be a portion of the rear plate 56*b* which has been formed into its unique shape.

It is preferred that the rear plate 56*b* defines a cutout which forms a second spring bay 86 which may define lateral edges of the second spring member 84. It is preferred that the second spring bay 86 have a trapezoidal shape, as such a shape best suits the preferred shape of the second spring member 84, with the wider end being the second origination end 88 of the second spring member 84. This shape may allow the second spring member 84 to bend without significant risk of outside debris or matter impeding the second spring member 84. However, those of ordinary skill in the art will appreciate from this disclosure that the second spring bay 86 may be provided in any suitable shape without exceeding the scope of this invention.

Referring first to the rough geometric shape of the perimeter of the second spring member 84, the second spring member 84 preferably begins with a second origination end 88 extending from the rear plate 56*b*, and ends in a second spring tip 89. The second spring member 84 is further preferably roughly trapezoidal in shape, with a lateral width of the second spring member 84 decreasing between the second origination end 88 and the second spring tip 89. However, those of ordinary skill in the art will appreciate from this disclosure that the second spring member 84 may be rectangular, triangular, or make take any other suitable shape without exceeding the scope of this disclosure.

Referring next to the three-dimensional curvature of the second spring member 84, it is preferred that the second spring member 84 has both a convex and a concave curve, such that the second spring member 84, as with the first spring member 64, resembles an ocean wave. Specifically, from the second origination end 88, it is preferred that the second spring member 84 extend to define a second convex surface 85, then to form a second concave surface 87 before ending in the second spring tip 89. It is preferred that the second spring member 84 be sufficiently curved such that it extends to fill a significant portion of the second gap 80 when no pick is located within the second gap 80, preferably between 50 and 95% of the vertical space in the second gap 80. At the same time, it is also preferred that the second spring member 84 be sufficiently curved such that the second spring tip 89 is at least partially within the second spring bay 86 when no pick is located within the second gap 80.

Referring to the width of the second spring member 84, it is preferred that the second spring member 84 have a constant thickness throughout the second convex surface 85 and the second concave surface 87. It is further preferred that this constant thickness of the second spring member 84 be less than the thickness of the rear plate along a portion of a perimeter of the second spring bay 86 proximate to the second spring tip 89.

Figure 5:
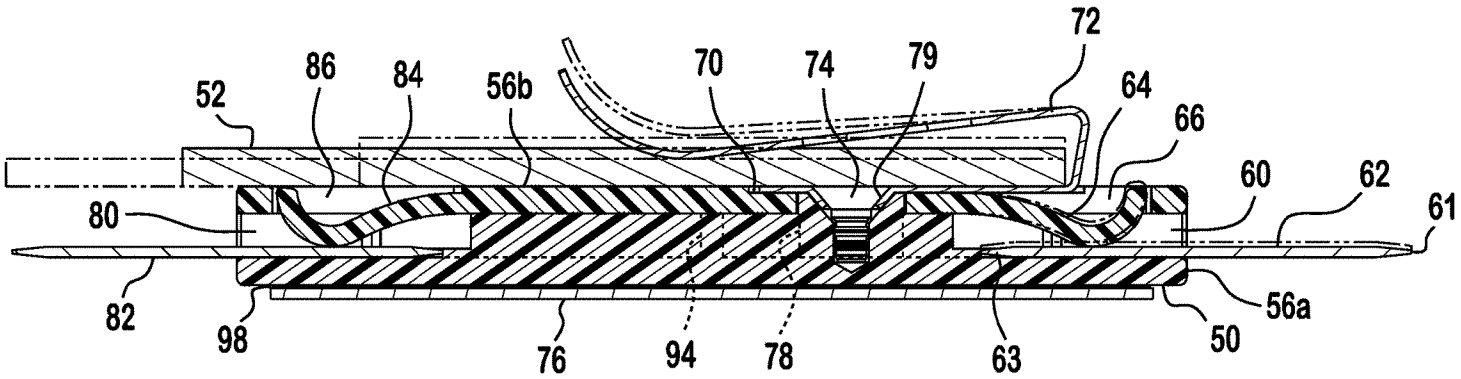
FIG. 5 is a left side cross sectional view of the pick holder 50 of FIG. 2 as taken along the lines 5-5 of FIG. 2 which demonstrates the preferred springing action of the clip member 72 which may hold the pick holder 50 on a guitar strap 52 or other surface. The figure further demonstrates the springing action of the first spring member 64 and second spring member 84. Broken lines in the figure demonstrate how the clip member 72, first spring member 64, and second spring member 84 might flex depending on the width of the guitar strap 52, first pick 62, or second pick 82, respectively.
Figure 6:
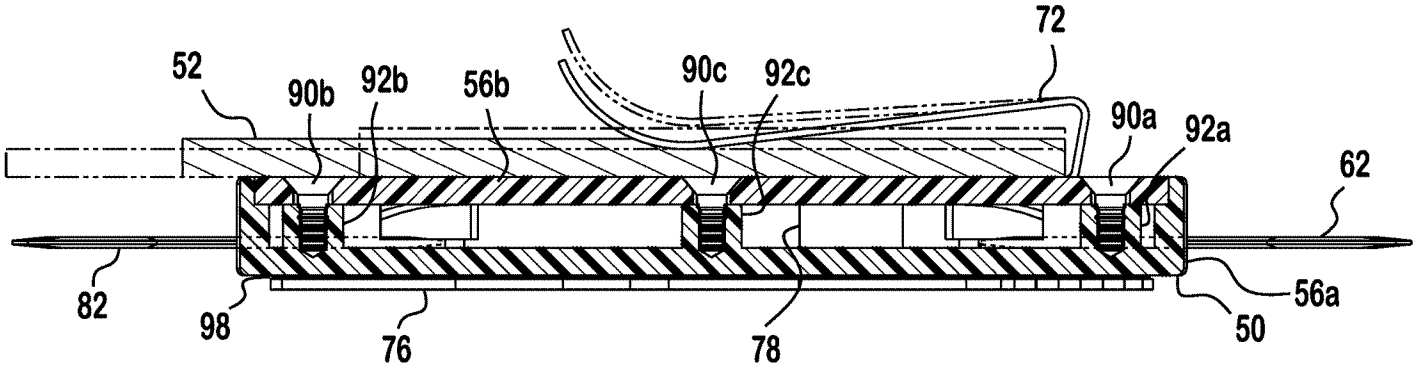
FIG. 6 is a left side cross sectional view of the pick holder 50 as taken along the lines 6-6 in FIG. 2 which demonstrates the preferred springing action of the clip member 72. Broken lines in the figure demonstrate how the clip member 72 might flex depending on the width of the guitar strap 52 onto which it has been slid.
Figure 7:
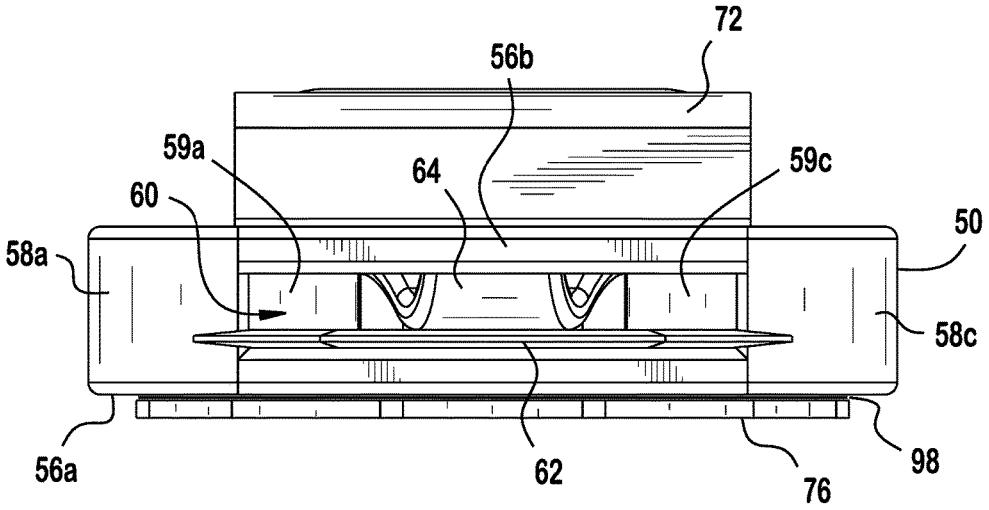
FIG. 7 is a top plan view of the pick holder 50 which demonstrates the extent to which the first spring member 64 extends into the first gap 60 and how such extension allows the first spring member 64 to contact the first pick 62.
Figure 8:
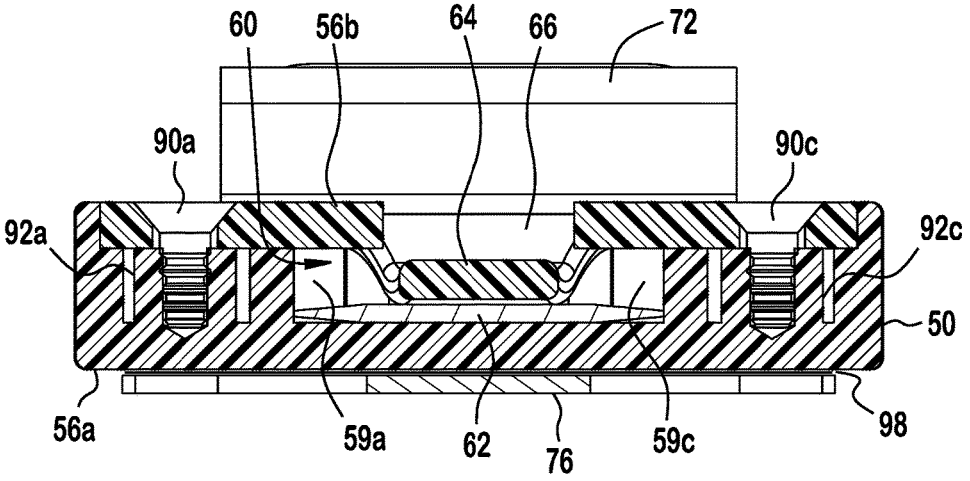
FIG. 8 is a cross-sectional view of the pick holder 50 as taken along the lines 8-8 in FIG. 3, demonstrating the relative position of the first spring member 64, and more specifically the first spring tip 69, in relation to the rest of the rear plate 56*b*. The figure further demonstrates how the clamping screws, such as the first clamping screw 90*a* and third clamping screw 90*c*, may fit into their respective screw housings, such as the first screw housing 92*a* and third screw housing 92*c*, to connect the rear plate 56*b* to the front plate 56*a*.
Figure 9:
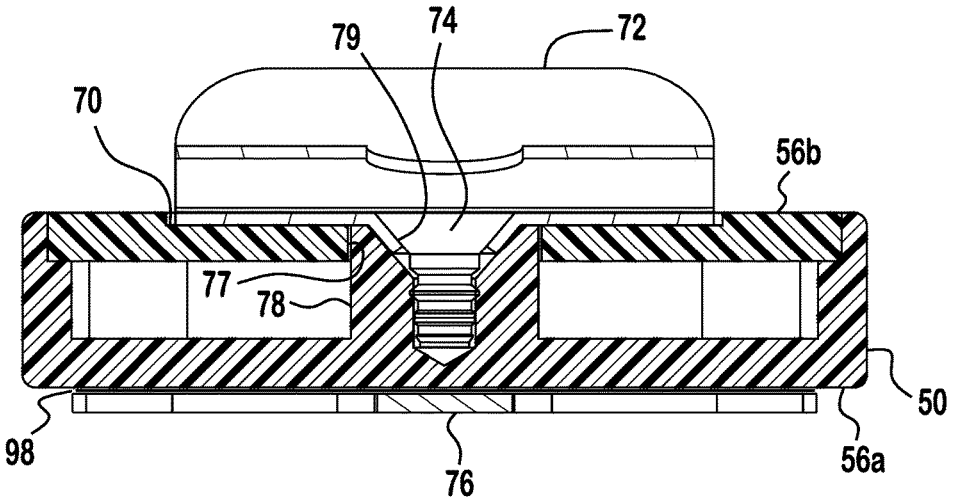
FIG. 9 is a cross-sectional view of the pick holder 50 as taken along the lines 9-9 in FIG. 3, demonstrating how the clip member 72 may be placed in the clip member recess 70, a recessed portion in the rear plate 56*b* roughly rectangular in shape. The fastener screw 74 may be placed through a fastener bore 79 in the clip member 72, which may extend through the fastener placement hole 77 in the rear plate 56*b*. The fastener screw 74 may then be screwed into the fastener housing 78, adding additional connection between the front plate 56*a* and rear plate 56*b*.
Figure 10:
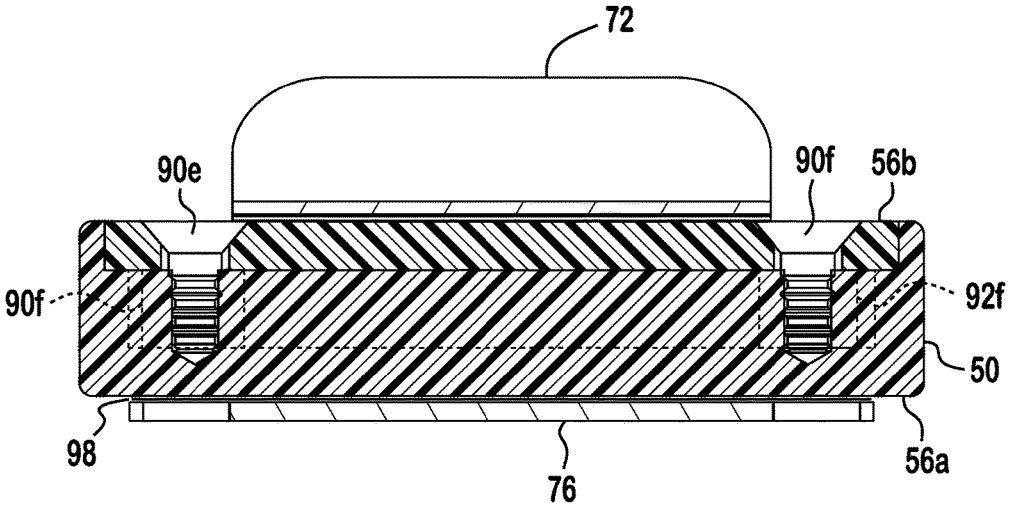
FIG. 10 is cross-sectional view of the pick holder 50 as taken along the lines 10-10 in FIG. 3, demonstrating how the fifth and six clamping screws 90*e* and 90*f*, positioned along the central horizontal axis of the holder body 54, may fit into their respective screw housings, fifth screw housing 92*e* and sixth screw housing 92*f*, to provide additional horizontal support to connect the rear plate 56*b* to the front plate 56*a*.
Figure 11:
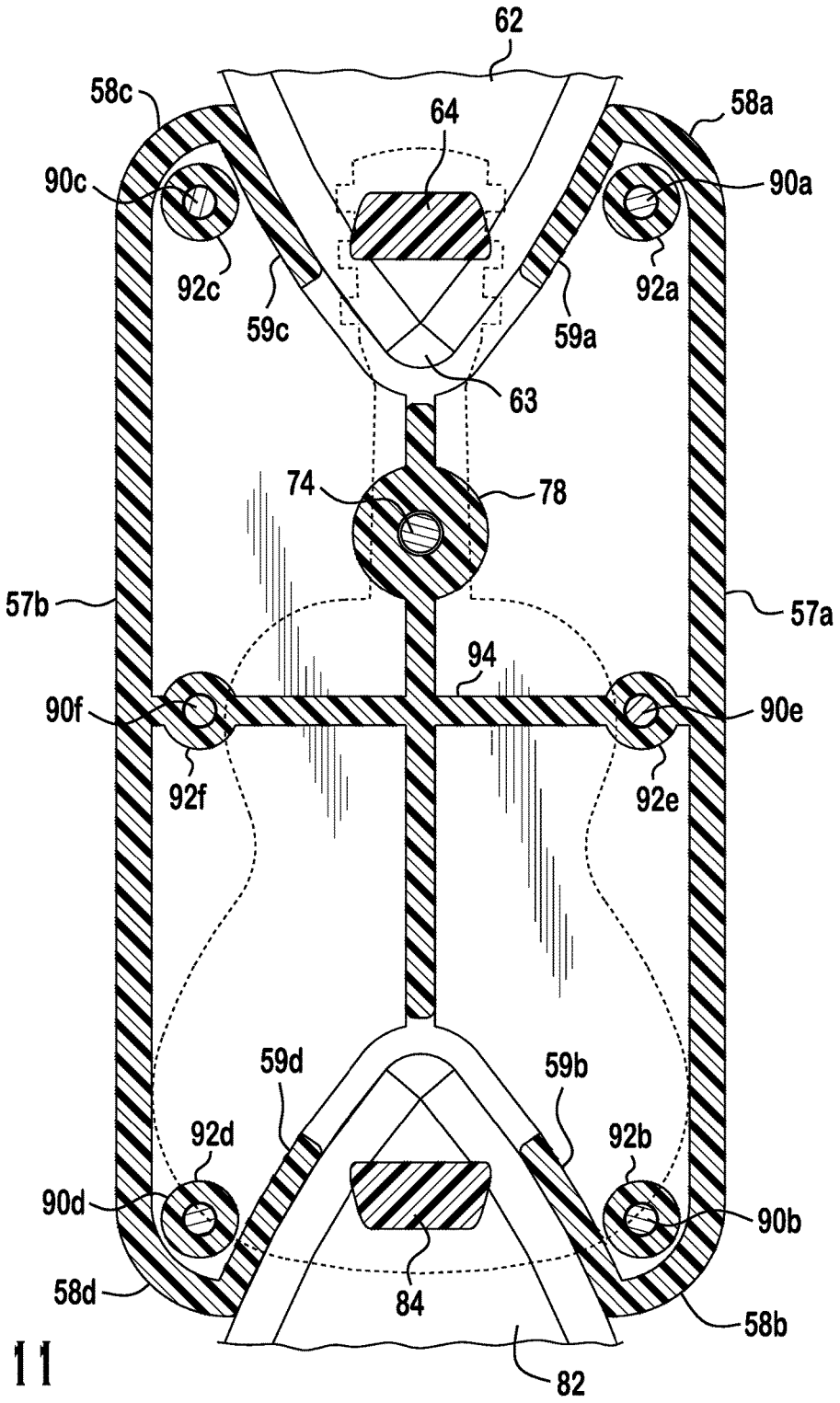
FIG. 11 is a cross-sectional view of the pick holder 50 as seen from the rear, demonstrating the preferred configuration of the interior side of the front plate 56*a*. Preferably, the front plate 56*a* defines a first side wall 57*a* positioned opposite of a second sidewall 57*b*. It is preferred that, on opposing axial ends, the first side wall 57*a* forms a first insert wall 59*a* and a second insert wall 59*b*. Similarly, it is preferred that, on opposing axial ends, the second side wall 57*b* forms a third insert wall 59*c* and a fourth insert wall 59*d*. Through such a configuration, the first and third insert walls 59*a* and 59*c* provides a rough wedge shape which may prevent a first pick 64 from being over-inserted into the pick holder 50 when place in the first gap 60. This may be accomplished by allowing the playing end 61 of the first pick 62 to abut the first and third insert walls 59*a* and 59*c*. The second and fourth insert walls 59*b* and 59*d* provides a similar rough wedge shape which may prevent a second pick 84 from being over-inserted into the pick holder 50 when place in the second gap 80.
Figure 18:
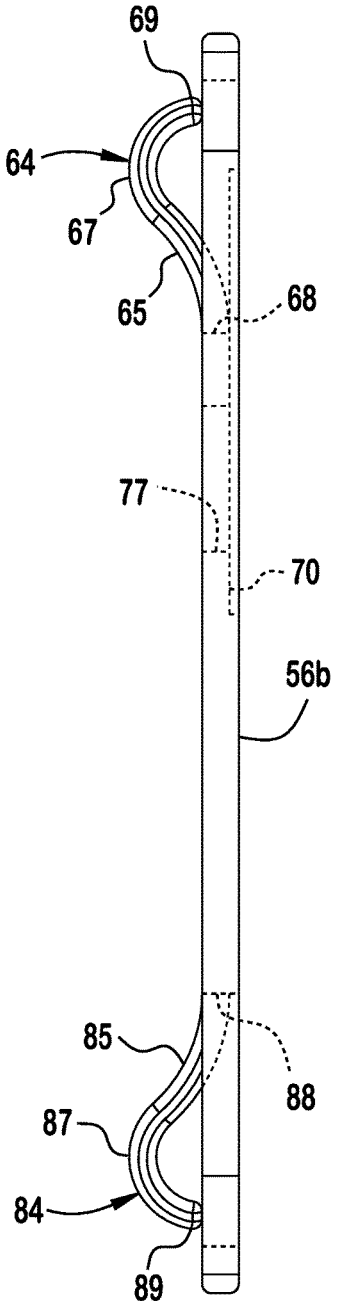
FIG. 18 is a right side elevational view of the rear plate 56*b* of FIG. 17, demonstrating that it is preferred that the first spring member 64 and second spring member 84 extend to an identical height into the first gap 60 and second gap 80 respectively. It is also preferred that both the first spring tip 69 extends at least partially into the first spring bay 66 and the second spring tip 89 extends at least partially into the second spring bay 86 when no pick is inserted into either the first gap 60 or second gap 80.
Figure 19:
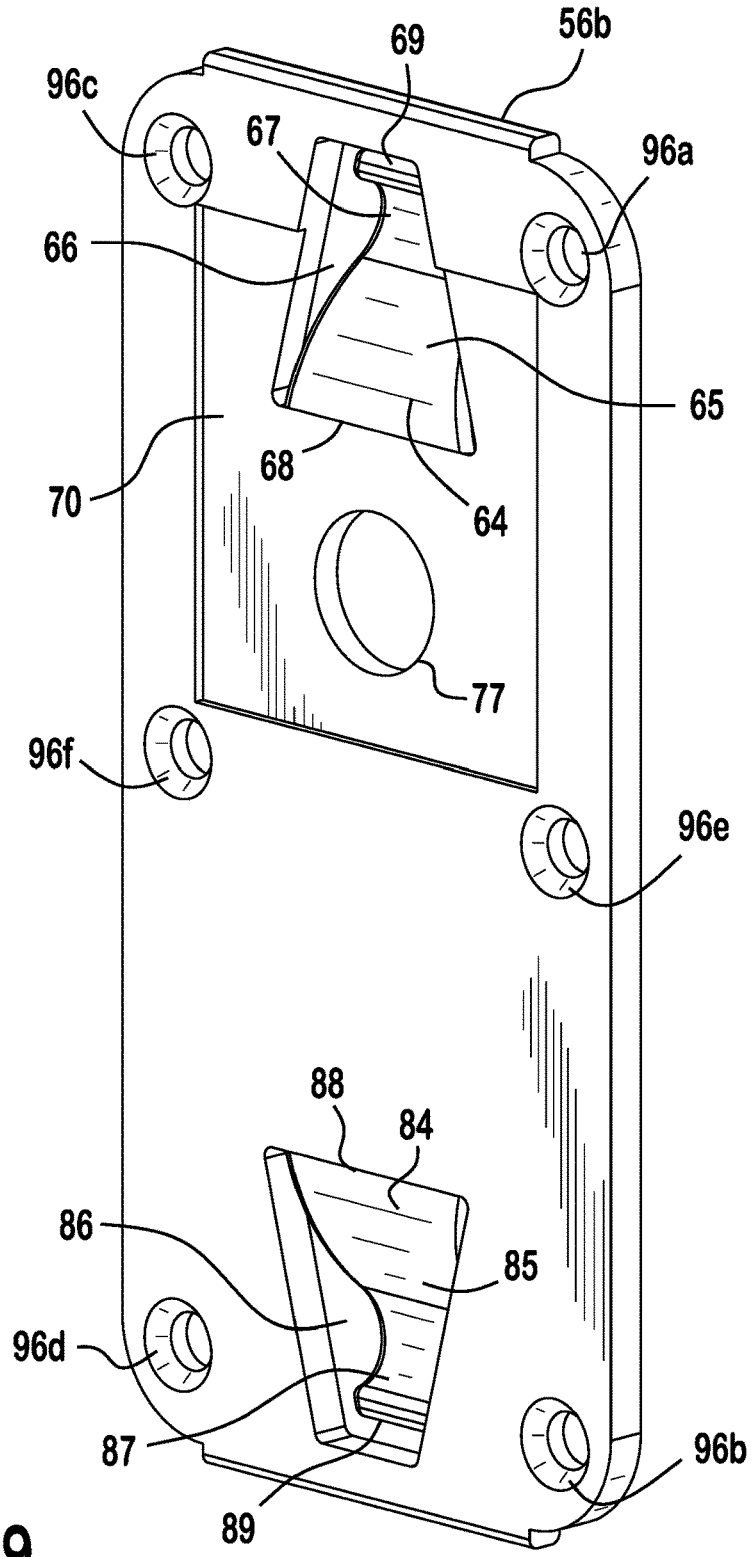
FIG. 19 is a perspective view of a rear side, or outer side, of the rear plate 56*b* demonstrating what would be the outer surface when the holder body 54 is assembled. The figure demonstrates that the first spring bay 66 and second spring bay 86 are preferably formed of a partial cutaway of the rear plate 56*b* and are roughly trapezoidal in shape. It is preferred that the first spring member 64 and second spring member 84 both be formed of the same, single piece as the rear plate 56*b* rather than being provided as a different piece and attached after manufacture of the rear plate 56*b*. The figure further demonstrates that it is preferred that the clamping bores 96*a-f* be comprised of beveled edges to catch the clamping screws 90*a-f*, along generally circular holes. It is also preferred that a clip member recess 70 be provided as a recessed region in the rear plate 56*b* into which the clip member 72 may easily be set. It is also preferred that a bore placement hole 77 be included as a roughly circular hole in the rear plate 56*b* beneath where the clip member 72 may be set, to allow the fastener screw 74 and fastener bore 79 to pass therethrough.

Referring to FIGS. 5-6 and 18, it is preferred that the pick holder 50 be comprised of a material which provides a degree of flexibility while also retaining an elasticity to allow elements of the pick holder 50 to retain their shape when a force is not being applied to cause them to bend. For example, FIGS. 5 and 6 show various positions the first spring member 64 and second spring member 84 might flex into depending on the width of the first pick 62 or second pick 82 (or plurality of picks) inserted into the first gap 60 or second gap 80 respectively. However, as FIG. 18 shows, it is also preferred that the first spring tip 69 and second spring tip 69 might return to a their original positions partially within the first spring bay 66 and second spring bay 86 respectively when no picks have been inserted to the first gap 60 or second gap 80 respectively. It is the flexibility of the first and second spring members 64, 84 which allows picks to be pushed into either the first or second gaps 60, 80, which have been partially filled by first and second spring members 64, 84 respectively. And it is the ability of the first and second spring members 64, 84 to retain their respective shapes which generates the friction necessary to bias one or more picks to remain in the first or second gaps 60, 80 once inserted therein. FIGS. 5 and 6 also demonstrate the preferred ability of the clip member 72 to flex to accommodate guitar straps 52 of various thicknesses. Like the first and second spring members 64, 84, it is also preferred that the clip member 72 generally return to its original shape, as such a tendency will create the friction necessary to cause the pick holder 50 to remain on a guitar strap 52.

In summary, it is preferred that the first spring member 64 and first gap 60, and the second spring member 84 and second gap 80 be identical to one another, differing only in their location and orientation on the rear plate 56*b*. Those of ordinary skill in the art will appreciate from this disclosure any preferred configurations of one of the first spring member 64 and first gap 60, and the second spring member 84 and second gap 80 may be applied to other spring members of gaps without exceeding the scope of this disclosure.

Figure 20:
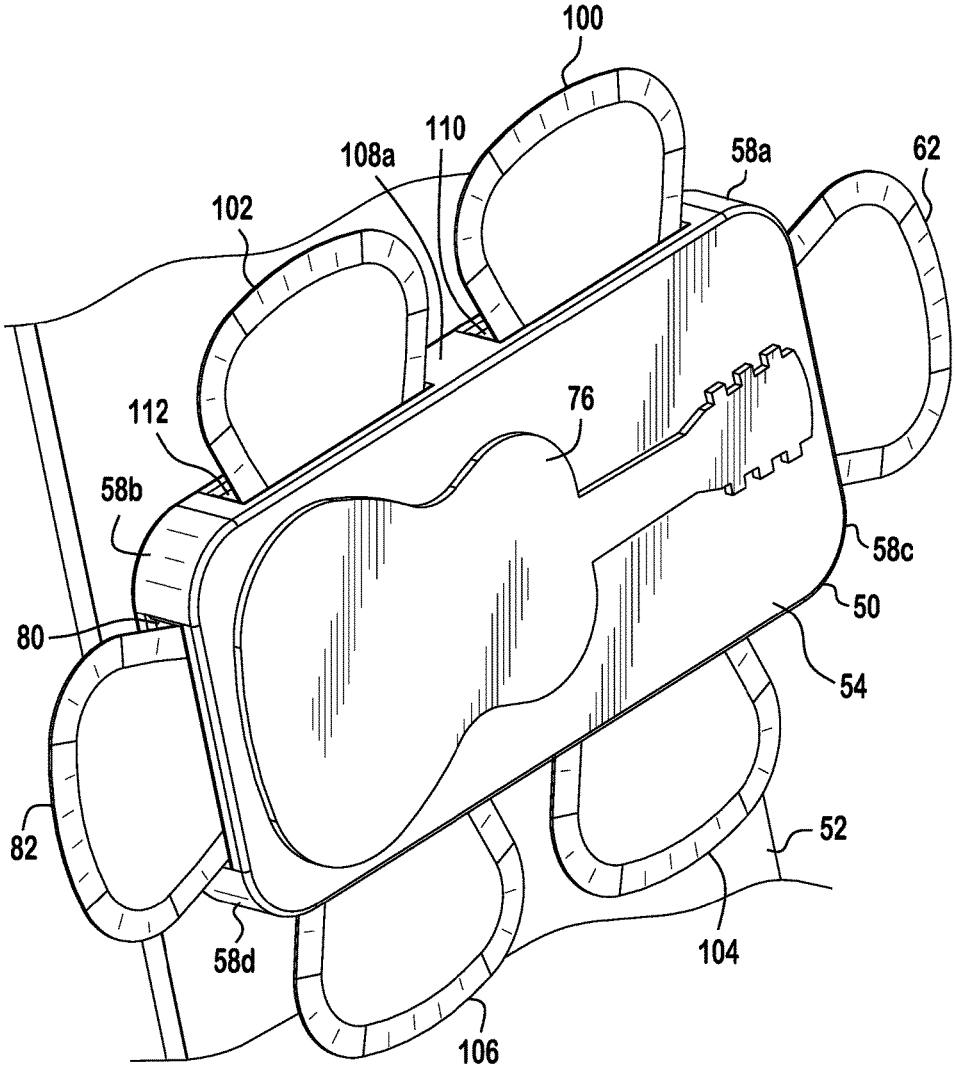
FIG. 20 is a perspective view of an alternate embodiment of pick holder 50, wherein the pick holder may be configured to hold a first pick 62, a second pick 82, a third pick 100, a fourth pick 102, a fifth pick 104, and a sixth pick 106. In such an embodiment, it can be seen that E-shape sidewalls such as E-shape side wall 108*a* are preferably included in the place of first abd second side walls 57*a* and 57*b*.
Figure 21:
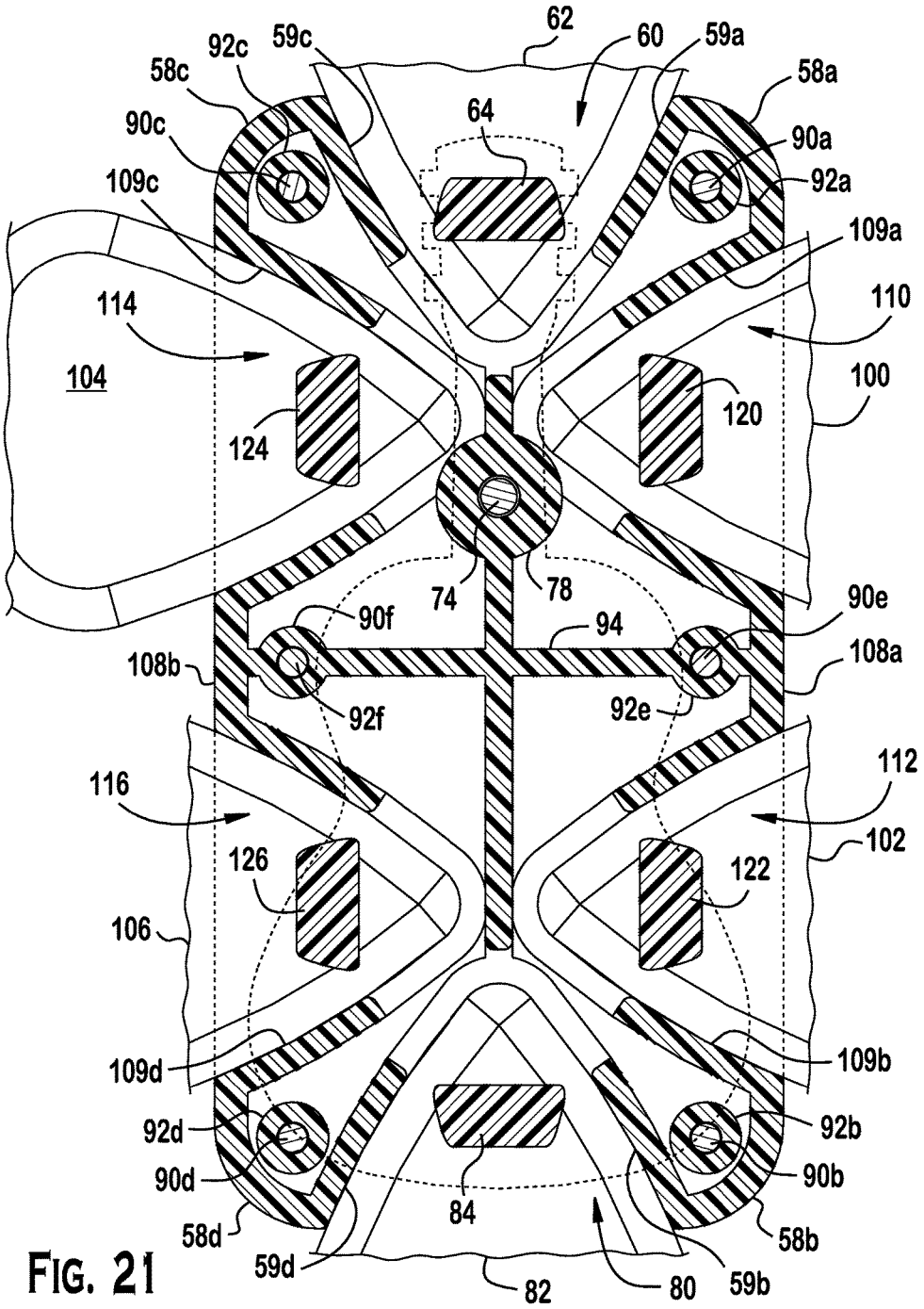
FIG. 21 is a cross sectional view of the alternate embodiment of the pick holder 50 as shown in FIG. 20. The figure demonstrates that in this configuration, it is preferred that: the first pick 64 be inserted into the first gap 60 formed of the first insert wall 59*a* and third insert wall 59*b*, and detachably held therein by the first spring member 64; the second pick 84 be inserted into the second gap 80 formed of the second insert wall 59*b* and fourth insert wall 59*d*, and detachably held therein by the second spring member 84; the third pick 100 be inserted into the third gap 110 formed of the first side insert wall 109*a* and the first E-shape sidewall 108*a*, and detachably held therein by the third spring member 120; the fourth pick 102 be inserted into the fourth gap 112 formed of the first E-shape sidewall 108*a* and second side insert wall 109*b*, and detachably held therein by the fourth spring member 122; the fifth pick 104 be inserted into the fifth gap 114 formed of the third side insert wall 109*c* and the second E-shape sidewall 108*b*, and detachably held therein by the fifth spring member 124; and the sixth pick 106 be inserted into the sixth gap 116 formed of the fourth side insert wall 109*d* and the second E-shape sidewall 108*b*, and detachably held therein by the sixth spring member 126.

Referring to FIGS. 20-21, it is also preferred that up to six gaps may be provided to hold up to six picks therein, secured therein by up to six spring members, all of identical properties differing only in their location and orientation on the rear plate 56*b*. Thus, it is preferred that: the first pick 64 be inserted into the first gap 60 formed of the first insert wall 59*a* and third insert wall 59*c*, and detachably held therein by the first spring member 64; the second pick 84 be inserted into the second gap 80 formed of the second insert wall 59*b* and fourth insert wall 59*d*, and detachably held therein by the second spring member 84; the third pick 100 be inserted into the third gap 110 formed of the first side insert wall 109*a* and the first E-shape sidewall 108*a*, and detachably held therein by the third spring member 120; the fourth pick 102 be inserted into the fourth gap 112 formed of the first E-shape sidewall 108*a* and second side insert wall 109*b*, and detachably held therein by the fourth spring member 122; the fifth pick 104 be inserted into the fifth gap 114 formed of the third side insert wall 109*c* and the second E-shape sidewall 108*b*, and detachably held therein by the fifth spring member 124; and the sixth pick 106 be inserted into the sixth gap 116 formed of the fourth side insert wall 109*d* and the second E-shape sidewall 108*b*, and detachably held therein by the sixth spring member 126. Those of ordinary skill in the art will appreciate from this disclosure that the properties and limitations discussed above in regards to the first and second gaps 60, 80, first and second spring members 64, 84, and picks 62, 82 may be applied to any of these additional elements without exceeding the scope of this disclosure.

Referring to FIGS. 7-14, the inner side of the front plate 56*a* preferably forms a number of support structures which may provide stability to the holder body 54 and may facilitate affixing the rear plate 56*b* to the front plate 56*a*. Those of ordinary skill in the art will appreciate from this disclosure that these structures are only preferred, and the front plate 56*a* may be formed of any suitable structures without exceeding the scope of this invention.

It is preferred that the front plate 56*a* define a first side wall 57*a* and second sidewall 57*b*. Preferably, the first sidewall 57*a* extends in longitudinal directions, with the upper portion turning at a first corner 58*a* and then defining a first insert wall 59*a* formed along the first gap 60, and the lower portion turning at a second corner 58*b* and then defining a second insert wall 59*b* formed along the second gap 80. Similarly, it is preferred that the second sidewall 57*b* also extends in longitudinal directions, with the upper portion turning at a third corner 58*c* and then defining a third insert wall 59*c* formed along the first gap 60, and the lower portion turning at a fourth corner 58*d* and then defining a fourth insert wall 59*d* formed along the second gap 80. It is preferred that the pair of the first insert wall 59*a* and third insert wall 59*c*, and the pair of the second insert wall 59*b* and fourth insert wall 59*d*, each generally define a V-shape approximating the playing end 61 of a pick. It is preferred that the angle at which the insert wall pairs are positioned is less than 90 degrees, to best match the angle of the playing end 61 of most picks, such as the first pick 62. However, those of ordinary skill in the art will appreciate from this disclosure that the insert walls may be positioned at any suitable angle, or may comprise shapes other than a wedge, such as being squared or curved, without exceeding the scope of this invention. Through this preferred configuration, the plurality of insert walls 59*a-d*, located within the holder body 54, will abut a portion of the playing end 61 of the first pick 62 when the first pick 62 is fully inserted into the first gap 60 such that a portion of the gripping end 63 of the first pick 62 protrudes from the holder body 54. This may allow picks to be more easily removed from the pick holder 50 by the player.

It is further preferred that the front plate 56*a* further defines a support frame 94, which may run along the first and second sidewalls 57*a* and 57*b*, as well as forming a rough shape of a cross along rough horizontal and vertical axis of the holder body 54. This preferred shape is preferred, as the portion of the support frame 94 running along the first and second sidewalls 57*a-b* may allow the rear plate 56*b* to be held against the front plate 56*a* without losing the first or second gaps 60, 80. The central portion of the support frame 94 preferably forms a rough cross shape to allow the holder body 54 to retain structural stability without the center of the holder body 54 collapsing inward when the front plate 56*a* and rear plate 56*b* are attached to one another. However, those of ordinary skill in the art will appreciate from this disclosure that support frame 94 may be formed of any suitable shape, such as an "X" or vertical or horizontal lines or a grid, without exceeding the scope of this disclosure.

It is also preferred that the front plate 56*a* further defines a number of screw housings into which a corresponding number of clamping screws may be inserted. These screw housings may be roughly circular in shape, with an inner bore shape to fit the size of the desired clamping screws. It is preferred that a first screw housing 92*a* be positioned along the first corner 58*a* between the first sidewall 57*a* and the first insert wall 59*a*, that the second screw housing 92*b* be positioned along the second corner 58*b* between the first sidewall 57*a* and the second insert wall 59*b*, that the third screw housing 92*c* be positioned along the third corner 58*c* between the second sidewall 57*b* and the third insert wall 59*c*, and that the fourth screw housing 92*d* be positioned along the fourth corner 58*d* between the second sidewall 57*b* and the fourth insert wall 59*d*. In some embodiments, a fifth screw housing 92*e* and a sixth screw housing 92*f* may be positioned along the horizontal axis of the holder body 54, and may preferably be formed by a portion of the support frame 94. A fastener housing 78 is preferably also formed by the front plate 56*a*, into which a corresponding fastener screw 74 may be inserted. The fastener housing 78 may be roughly circular in shape, with an inner bore shape to fit the size of the fastener screw 74. Preferably, the fastener housing 78 is larger than the screw housings 92*a-f*, and may include a beveled or rounded edge around the hole. The fastener housing 78 may be positioned along the vertical axis of the holder body 54, and may be formed by a portion of the support frame 94. Those of ordinary skill in the art will appreciate from this disclosure that any number of screw housings or fastener housings may be provided, and in any position within the holder body 54, without exceeding the scope of this invention.

Referring to the preferred relative heights of the structures which may be formed on the interior side of the front plate 56*a*, the sidewalls 57*a-b* be the highest structure, with the fastener housing 78 being the next highest. It is then preferred that the screw housings 92*a-f*, support frame 94, and insert walls 59*a-d* be of a uniform height, extending to the height at which it is preferred that the rear plate 56*b* might sit when placed against the front plate 56*a* and attached thereto.

The pick holder 50 and its component parts are preferably configured such that a face plate 76 be placed on the front side, or outer side, of the front plate 56*a*, and adhered thereto by an adhering element, such as magnets or glue. It is then preferred that the front side, or inner side, of the rear plate 56*b* be placed against the rear side, or inner side, of the front plate 56*a*. Preferably, the rear plate 56*b* may be placed between the first sidewall 57*a* and second sidewall 57*b* and may rest on the support frame 94, with the bore placement hole 77 being located over the fastener housing 78 and each clamping bore 96*a-f* being located over their respective screw housings 92*a-f*. It is further preferred that the clip member 72 be placed into the clip member recess 70 such that the fastener bored 79 be placed through the bore placement hole 77 such that it might be located over the fastener housing 78. The fastener screw 74 may be then be inserted though the fastener bore 79 and screwed into the fastener housing 78, attaching the clip member 72 to the holder body 54 and providing the first adhesive element to connect the front plate 56*a* and the rear plate 56*b*. It is then preferred that the clamping screws 90*a-f* be placed into their respective clamping bores 96*a-f* and be screwed into their respective screw housings 92*a-f* to fully secure the front plate 56*a* to the rear plate 56*b*. Thus, it is preferred that: the first clamping screw 90*a* be placed into the first clamping bore 96*a*, and screwed into the screw housing 92*a*; the second clamping screw 90*b* be placed into the second clamping bore 96*b* and screwed into the second screw housing 92*b*; the third clamping screw 90*c* be placed into the third clamping bore 96*c* and screwed into the third screw housing 92*c*; the fourth clamping screw 90*d* be placed into the fourth clamping bore 96*d* and screwed into the fourth screw housing 92*d*; the fifth clamping screw 90*e* be placed into the fifth clamping bore 96*e* and screwed into the fifth screw housing 92*e*; and the sixth clamping screw 90*f* be placed into the sixth clamping bore 96*f* and screwed into the sixth screw housing 92*f*. It is preferred that when the clamping screws 90*a-f* have been fully screwed into the screw housings 92*a-f*, the clamping screws 90*a-f* may sit flush with the outer surface of the rear plate 56*b*.

It is recognized by those skilled in the art that changes may be made to the above described methods without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A pick holder for securing a pick having a playing end and a gripping end, comprising:

a holder body having a front plate and a rear plate, the holder body further having at least one sidewall extending generally planar perpendicular to the front plate and the rear plate, the holder body defining a first gap between the front plate and the rear plate, the first gap being configured to have the playing end of the pick inserted therein;

a first portion of the rear plate forming a first spring member that extends into the first gap to detachably secure the pick therein such that the rear plate and the first spring member are a single, integral, one piece body, and wherein the rear plate defines a first cutout forming a first spring bay and defining lateral edges of the first spring member.

2. The pick holder of claim 1, wherein the first spring member has a first origination end which remains connected to and an integral part of the rear plate, the first spring member extending from the first origination end to define a first convex surface, then to form a first concave surface, and then to end in a first spring tip.

3. The pick holder of claim 2, wherein the first spring tip is at least partially within the first spring bay when no pick is located within the first gap.

4. The pick holder of claim 3, wherein the first spring member has a constant thickness throughout the first convex surface and the first concave surface.

5. The pick holder of claim 4, wherein the constant thickness of the first spring member is less than a rear plate thickness along a portion of a perimeter of the spring bay proximate to the first spring tip.

6. The pick holder of claim 5, wherein the spring bay has a trapezoidal shape and a lateral width of the first spring member decreases between the first origination end and the first spring tip.

7. The pick holder of claim 6, further comprising a plurality of insert walls located within the holder body and configured to abut a portion of the playing end of the pick when the pick is fully inserted into the first gap such that a portion of the gripping end of the pick protrudes from the holder body.

8. The pick holder of claim 2, further comprising:

the holder body defining a second gap between the front plate and the rear plate, the second gap being configured to have the playing end of the pick inserted therein;

a second portion of the rear plate forming a second spring member that extends into the second gap to detachably secure the pick therein such that the rear plate and the second spring member are a single, integral, one piece body, wherein the rear plate defines a second cutout forming a second spring bay and defining lateral edges of the second spring member; and wherein the second spring member has a second origination end which remains connected to and an integral part of the rear plate, the second spring member extending from the second origination end to define a second convex surface, then to form a second concave surface, and then to end in a second spring tip.

9. The pick holder of claim 8, wherein the first gap and the second gap are each configured to detachably secure the pick such that the pick is parallel to and adjacent to the front plate.

10. The pick holder of claim 9, wherein the first and second gaps are positioned on opposing first and second longitudinal ends, respectively, such that at least two picks can be detachably secured in opposite orientations in the pick holder.

11. The pick holder of claim 10, wherein the first spring tip is at least partially within the first spring bay when no pick is located within the first gap and wherein the second spring tip is at least partially within the second spring bay when no pick is located within the second gap.

12. The pick holder of claim 11, wherein the first spring member has a constant thickness throughout the first convex surface and the first concave surface and wherein the second spring member has the constant thickness throughout the second convex surface and the second concave surface.

13. The pick holder of claim 12, wherein the constant thickness of the first spring member is less than a rear plate thickness along a portion of a perimeter of the first spring bay proximate to the first spring tip and wherein the constant thickness of the second spring member is less than the rear plate thickness along a perimeter of the second spring bay.

14. A pick holder for securing a pick having a playing end and a gripping end, comprising:

a holder body having a front plate and a rear plate, the holder body further having at least one sidewall extending generally planar perpendicular to the front plate and the rear plate, the holder body defining a first gap between the front plate and the rear plate, the first gap being configured to have the playing end of the pick inserted therein; and a first portion of the rear plate forming a first spring member that extends into the first gap to detachably secure the pick therein such that the rear plate and the first spring member are a single, integral, one piece body, wherein the first spring member has a first origination end which remains connected to and an integral part of the rear plate, the first spring member extending from the first origination end to define a first convex surface, then to form a first concave surface, and then to end in a first spring tip and wherein the first spring member has a constant thickness throughout the first convex surface and the first concave surface.

15. The pick holder of claim 14, wherein a lateral width of the first spring member decreases between the first origination end and the first spring tip.

16. The pick holder of claim 7, wherein the rear plate further defines a recess, a clip member being secured within the recess, the recess is positioned adjacent to part of the first spring bay such that the clip member partially overlaps the first spring member when the clip member is secured to the holder body.

17. The pick holder of claim 8, wherein the rear plate further defines a recess, a clip member being secured within the recess, the recess is positioned adjacent to part of the first spring bay such that the clip member partially overlaps the first spring member when the clip member is secured to the holder body.

18. The pick holder of claim 13, wherein the rear plate further defines a recess, a clip member being secured within the recess, the recess is positioned adjacent to part of the first spring bay such that the clip member partially overlaps the first spring member when the clip member is secured to the holder body.

* * * * *